United States Patent [19]

Deutsch

[11] Patent Number: 4,597,047

[45] Date of Patent: Jun. 24, 1986

[54] ENGINE CONTROL SYSTEM INCLUDING ENGINE IDLE SPEED CONTROL

[75] Inventor: Robert W. Deutsch, Sugar Grove, Ill.

[73] Assignee: Motorola, Inc., Schaumburg, Ill.

[21] Appl. No.: 724,059

[22] Filed: Apr. 18, 1985

Related U.S. Application Data

[63] Continuation of Ser. No. 630,480, Jul. 13, 1984, abandoned.

[51] Int. Cl.[4] ..... F02M 3/00

[52] U.S. Cl. ..... 364/431.07; 123/339; 123/585

[58] Field of Search ..... 364/431.07, 431.10; 123/339, 585, 586, 587, 493

[56] References Cited

U.S. PATENT DOCUMENTS

| | | | |
|---|---|---|---|
| 4,203,395 | 5/1980 | Cromas et al. . | |
| 4,217,867 | 8/1980 | Madsen et al. . | |
| 4,219,000 | 8/1980 | Locher et al. . | |
| 4,237,833 | 12/1980 | Des Lauriers . | |
| 4,237,838 | 12/1980 | Kinugawa et al. . | |
| 4,242,994 | 1/1981 | Keely . | |
| 4,281,631 | 8/1981 | Yamaguchi . | |
| 4,305,360 | 12/1981 | Meyer et al. . | |
| 4,328,775 | 5/1982 | Ironside . | |
| 4,344,398 | 8/1982 | Ikeura . | |
| 4,354,466 | 10/1982 | Dudley et al. . | |
| 4,359,983 | 11/1982 | Carlson et al. . | |
| 4,364,347 | 12/1982 | Miyagi . | |
| 4,365,599 | 12/1982 | Ikeura . | |
| 4,380,979 | 4/1983 | Takase | 123/339 |
| 4,398,514 | 8/1983 | Nakamura | 123/339 |
| 4,413,714 | 11/1983 | Windsor . | |
| 4,428,341 | 1/1984 | Hassler et al. | 123/339 |
| 4,438,744 | 3/1984 | Hasegawa | 123/585 |
| 4,453,514 | 6/1984 | Martinsons et al. | 123/585 |
| 4,457,276 | 7/1984 | Ueda et al. | 123/339 |
| 4,491,922 | 1/1985 | Kobayashi et al. | 364/431.07 |

*Primary Examiner*—P. S. Lall

*Attorney, Agent, or Firm*—Phillip H. Melamed

[57] ABSTRACT

An engine control system is disclosed which includes engine idle speed control apparatus which implements a closed loop idle speed control by varying the amount of air provided to the engine by an air bypass valve. The control system develops an engine torque polarity signal related to the difference between actual current manifold air pressure and the average of the manifold air pressure which exists during engine idle. The torque polarity signal is utilized to implement engine deceleration control by selectively providing additional air and/or reduced fuel to the engine to implement engine fuel mixture enleanment during deceleration conditions. The engine idle speed control apparatus calculates an error signal related to the difference between actual engine speed and a calculated desired engine idle speed. When engine speed is close to the desired idle speed and engine throttle is closed, a closed loop engine idle speed control means is enabled which controls engine speed in accordance with both a signal directly proportional to the magnitude of the error signal and an integral signal related to the integral of the error signal. Until the closed loop idle speed control means is enabled, the magnitude of the integral signal is maintained constant at a magnitude related to the magnitude which existed for this signal when the idle speed control means was last enabled. The idle speed control error signal is utilized to control sampling of manifold air pressure to obtain the torque polarity signal.

12 Claims, 15 Drawing Figures

ENGINE CONTROL SYSTEM INCLUDING ENGINE IDLE SPEED CONTROL

This is a continuation of application Ser. No. 630,480, filed July 13, 1985 now abandoned.

CROSS REFERENCE TO RELATED APPLICATIONS

The present invention is related to the invention described in copending U.S. patent application Ser. No. 630,479, filed July 13, 1984, entitled, "Engine Control System", by Herbert B. Stocker and Robert W. Deutsch, having the same assignee as the present invention.

BACKGROUND OF THE INVENTION

The present invention is related to engine control systems which implement engine idle speed control. More specifically, the present invention is related to engine control systems which develop electrical control signals that are utilized to control engine idle speed.

Engine control systems are known in which an air bypass valve (dashpot) is provided such that under certain conditions, such as deceleration, additional air is provided to the engine fuel mixture. Such systems recognize that the idle speed of an engine bears a direct such an air bypass valve. One such system is disclosed relationship to the amount of additional air provided by in U.S. Pat. No. 4,453,514, entitled, "Engine Speed Adaptive Air Bypass Valve (Dashpot) Control", which is assigned to the same assignee as the present invention.

Some engine control systems have utilized the known relationship between the degree of air bypass valve actuation and idle speed to implement an idle speed control system in which a desired idle speed is calculated as a function of engine coolant temperature and the degree of bypass actuation is a function of the difference between actual engine speed and this desired engine idle speed. In these known systems, typically the control of idle speed is implemented in direct proportion to the difference between actual engine speed and desired idle speed. In some systems, the idle speed control is implemented by the enabling of a closed loop servo-control system when engine speed approaches the desired idle speed.

Typically, such engine idle speed control systems do not provide servo-control in accordance with the integral of the difference between actual engine speed and desired idle speed, as well as in proportion to the difference between actual and desired idle speed. By controlling idle speed in accordance with the integral of the difference between actual speed and desired idle speed during closed loop operation, an engine idle speed control system will reduce idle speed overshoot error by preventing the idle speed control from too rapidly responding to transient conditions. This will prevent engine stalls from occuring during transient conditions. However, providing an integral of the difference between actual speed and desired idle speed would typically slow the response of the idle speed control system thus lessening the desirability of the use of such a system. In addition, typically the prior idle speed control circuits are separate from other engine control circuits, thus requiring extra cost for the total engine control system.

SUMMARY OF THE INVENTION

An object of the present invention is to provide an engine control system for controlling engine idle speed which overcomes the above mentioned deficiencies of prior systems.

In one embodiment of the present invention an engine control system including engine idle speed control apparatus is provided. The control system comprises: means for providing an error signal related to the difference between actual sensed engine speed and a desired engine idle speed; means coupled to said error signal providing means for implementing, when enabled, a closed loop engine idle speed control in accordance with a control signal related to at least the magnitude of said error signal; and means coupled to said engine idle speed control means for selectively enabling said closed loop idle speed control means in response to at least the magnitude of said error signal being within a predetermined range about zero magnitude, wherein said closed loop idle speed control means includes an integrator means for developing an output integral signal representative of the integral of said error signal, wherein said control signal is determined in accordance with at least the magnitude of said output integral signal, and wherein said closed loop idle speed control means includes means for holding, until said closed loop idle speed control means is enabled, the magnitude of the output integral signal constant at a magnitude related to the magnitude which existed when said closed loop idle speed control means was last enabled.

Essentially, the above stated feature of the present invention relates to implementing a closed loop engine idle speed control in accordance with the integral of the difference between actual engine speed and a desired engine idle speed wherein the magnitude of the difference integral is maintained constant at its previous value whenever the closed loop engine idle speed apparatus is not enabled. By effectively holding the integral magnitude constant when the closed loop idle speed control means is not enabled, the time normally required for the control means to develop a proper integral signal output when the control means is enabled is eliminated. This aids the present invention in rapidly arriving at the desired engine idle speed control condition. This is accomplished while minimizing overshoot in the speed control system since an integral signal term is utilized. Typically engine idle speed will also be controlled in accordance with a signal which is directly proportional to the difference between actual engine speed and desired idle speed. Also, typically the engine idle speed control means will be enabled in response to a closed throttle position being sensed and in response to actual engine speed being substantially equal to a predetermined engine speed corresponding to a desired idle speed.

Another aspect of the present invention concerns additional utilization of the error signal provided by the engine idle speed control apparatus. This error signal is representative of the difference between actual engine speed and desired engine speed. The error signal is also utilized to effectively sample a signal related to the amount of fuel being consumed by the engine during engine idle conditions. This sample signal is then utilized to implement engine control by determining deceleration conditions by effectively comparing the actual amount of fuel consumption with the amount of fuel consumption during engine idle conditions and developing an engine control torque polarity signal equal to the difference. Preferably the fuel consumption signal which is sampled is the manifold air pressure signal which is related to the amount of air utilized in the engine air-fuel mixture. Thus in accordance with the above recited aspect of the present 1nvention, the error signal developed by the engine idle speed control apparatus, in addition to being utilized for implementing engine idle speed control, is also utilized to develop an idle speed fuel consumption reference signal which is then compared with actual sensed fuel consumption to effectively determine an engine torque polarity signal wherein engine control is then implemented in accordance with this engine torque polarity signal. It should be noted that this later aspect of the present invention is related to the invention claimed in the previously noted copending U.S. patent application by Herbert B. Stocker and Robert Deutsch entitled, "Engine Control System", and assigned to the same assignee as the present invention.

BRIEF DESCRIPTION OF THE DRAWINGS

For a more complete understanding of the present invention, reference should be made to the drawings in which.

DESCRIPTION OF THE PREFERRED EMBODIMENTS OF THE INVENTION

Figure 1A:
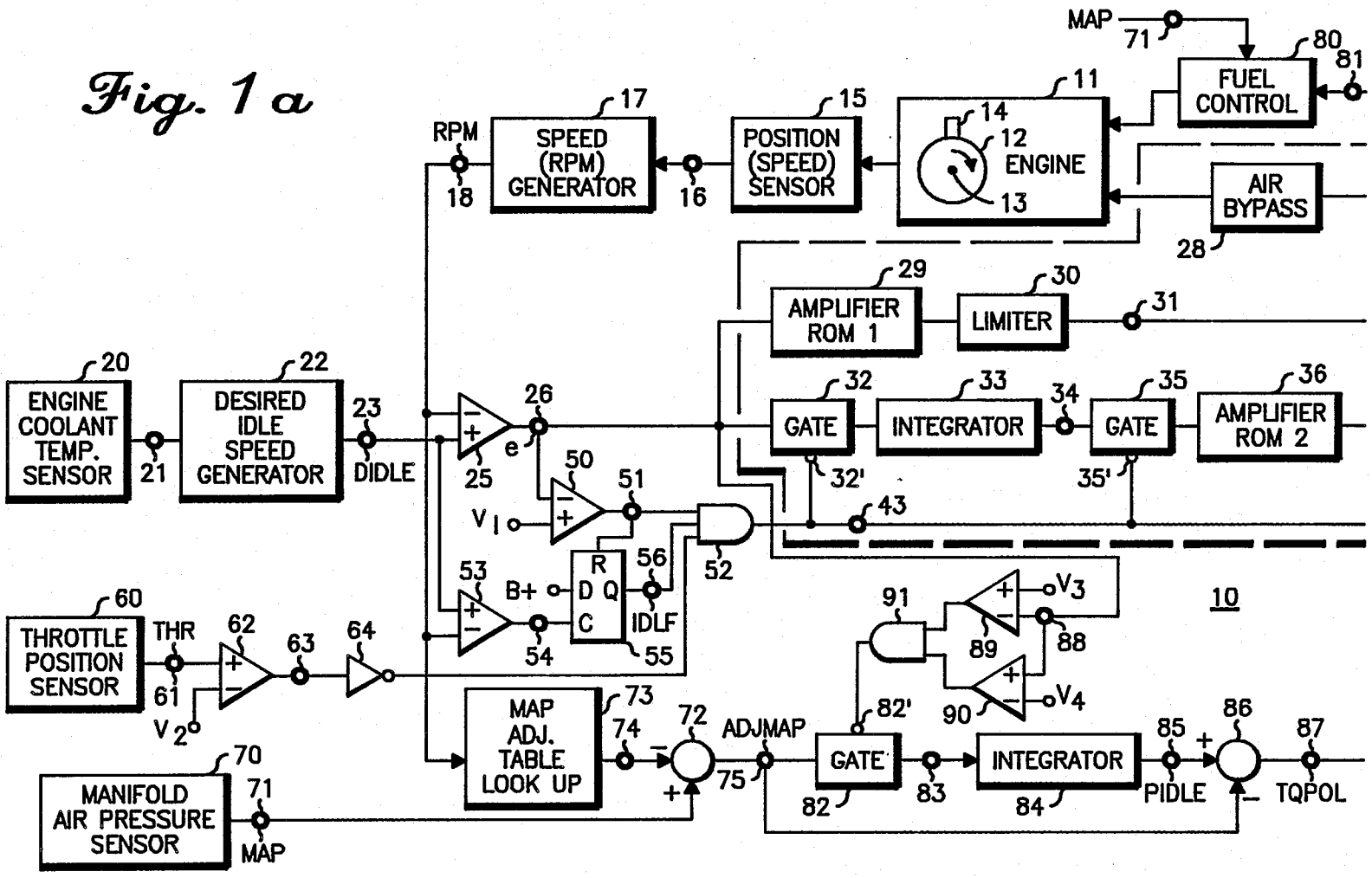
FIGS. 1*a* and 1*b* together illustrate a schematic diagram of an engine control system which incorporates the present invention.
Figure 1B:
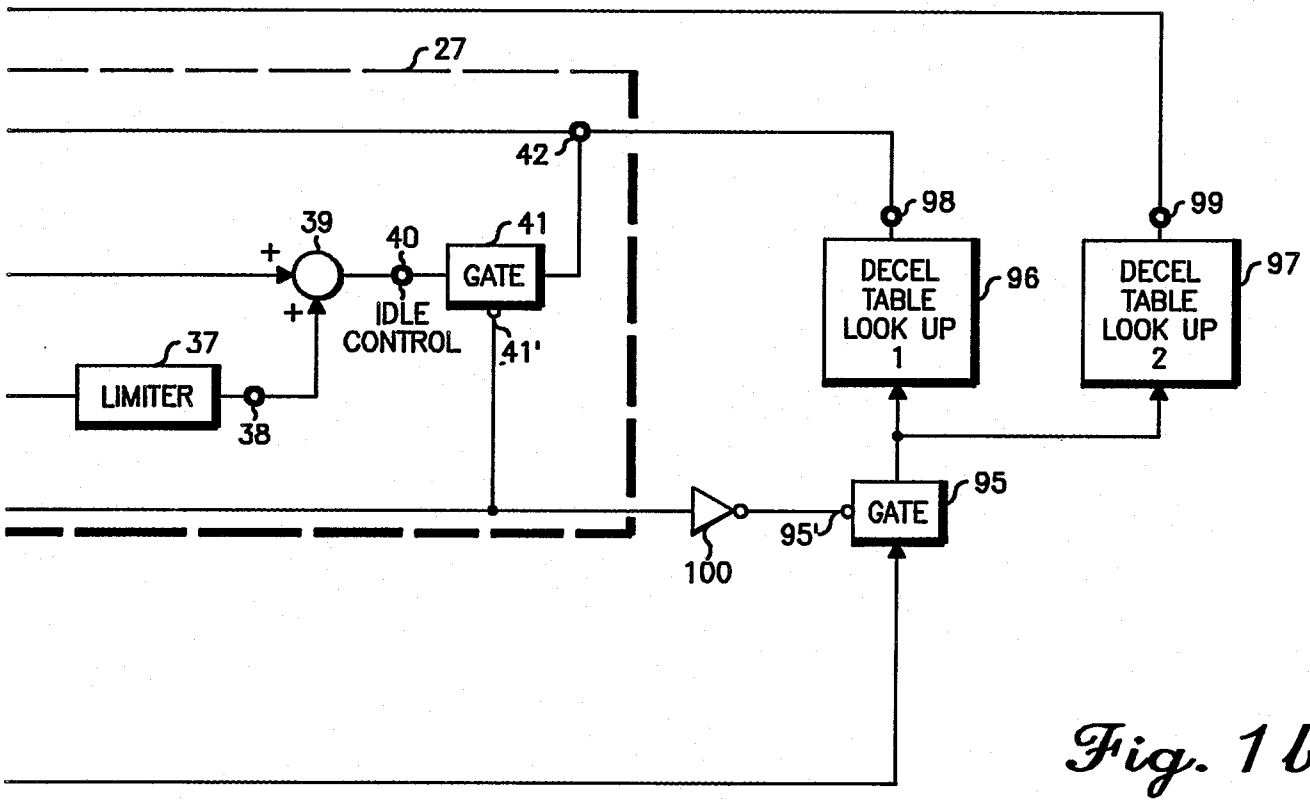

Referring to FIG. 1, an engine control system 10 is illustrated. An engine 11 is shown in block form and includes a body 12 coupled to the engine crankshaft (not shown) and rotated about an axis 13, corresponding to the crankshaft axis, and having an extending projection 14. Effectively coupled to the rotating body 12 of the engine 11 is a position (speed) sensor 15 which effectively senses the passage of the rotating projection 14 and develops a pulse signal at an output terminal 16 wherein the frequency of pulses at the terminal 16 is related to engine speed. The pulses at the terminal 16 are converted by a speed (RPM) generator 17 into an analog RPM signal provided at an output terminal 18. The generator 17 effectively integrates the pulses at terminal 16 to provide the RPM signal. The operation of the components 12 through 18 is conventional and well understood by those of average skill in the art. The end result is the providing of an analog signal RPM at the terminal 18 which has a magnitude representative of actual sensed engine speed.

Figure 2:
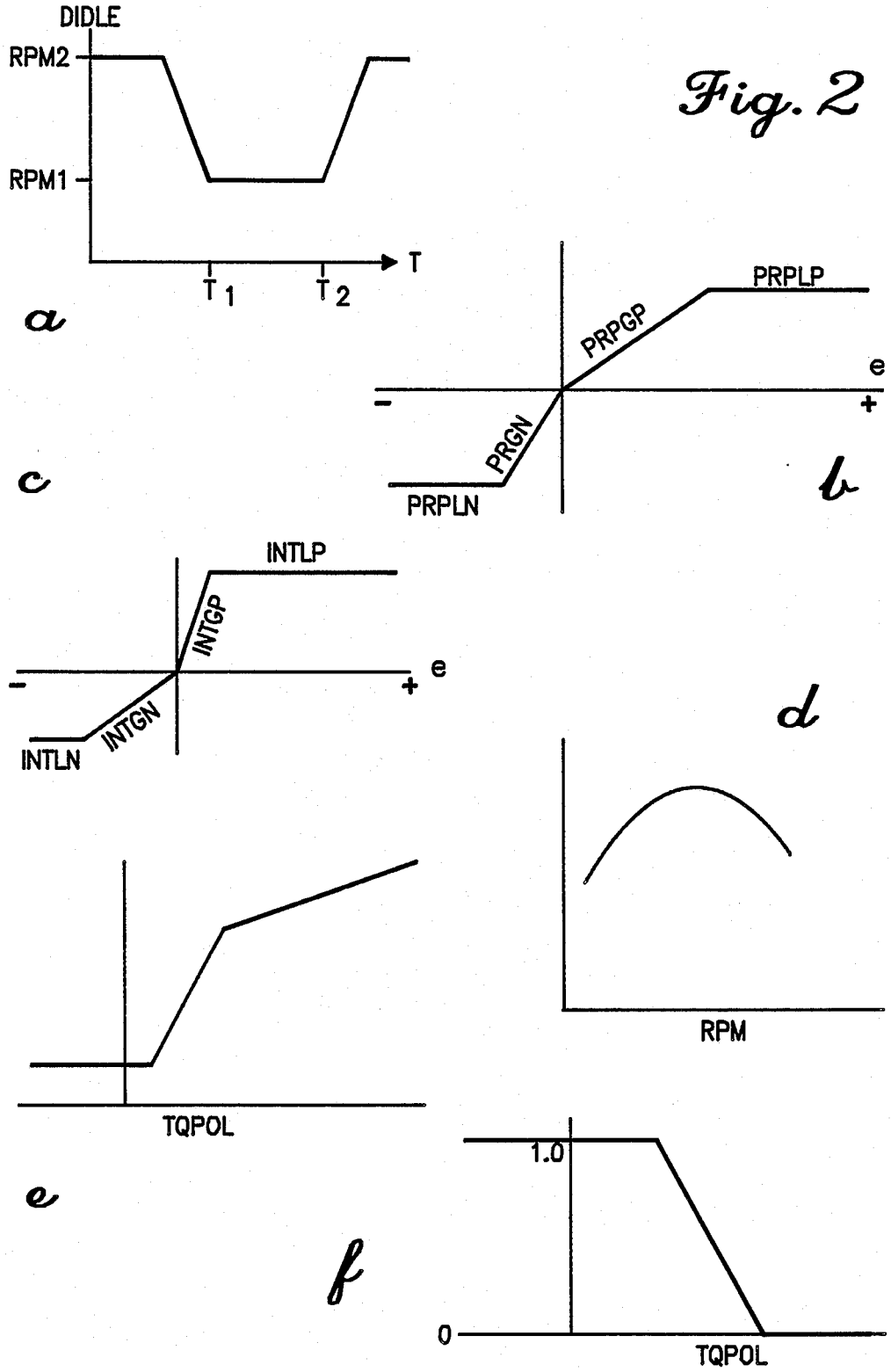
FIGS. 2*a* through 2*f* are a series of graphs illustrating input versus output transfer characteristics for several of the components shown in FIG. 1.

The system 10 includes an engine coolant temperature sensor 20 which provides an analog signal at a terminal 21 representative of engine coolant temperature. The terminal 21 is provided as an input to a desired idle speed generator 22 which effectively receives the temperature signal at the terminal 21 and provides, in response thereto, a calculated desired idle speed signal DIDLE at an output terminal 23. Graph a in FIG. 2 illustrates the input versus output transfer characteristic of the idle speed generator 22 wherein effectively for cold temperatures below $T_1$ a high idle speed of RPM 2 is provided, for normal engine temperatures between $T_1$ and $T_2$ a low idle speed of RPM 1 is provided, and for excessive temperatures again a high idle speed RPM 2 is provided. The function of the components 20 through 23 is conventional and well understood by those of average skill in the art.

The engine control system 10 includes an analog comparator 25 which receives at its positive input terminal the signal DIDLE and at its negative input terminal the signal RPM, and provides at an output terminal 26 an analog error signal e having a magnitude representative of the difference between the actual sensed engine speed RPM and the calculated desired engine idle speed DIDLE. The terminal 26 is provided as an input to an engine idle speed control means 27 shown dashed in FIG. 1. The control means 27 effectively implements engine idle speed control by controlling the degree of actuation of an air bypass valve 28 which selectively adds, in accordance with the magnitude of a received control signal, a predetermined amount of air to the air fuel mixture consumed by the engine 11. The air bypass valve 28 is sometimes also referred to as a dashpot and is typically controlled by receiving either an analog signal that controls the degree of actuation of the valve or receiving a pulse width modulated signal which effectively controls the degree of actuation of the valve. While the present invention provides for having the air bypass valve 28 receive a control signal, a stepper motor and air valve can also be utilized as the effective equivalent of the air bypass valve 28 wherein the amount of air provided by the stepper motor and its associated air valve would be controlled in accordance with a received analog or digital signal.

The idle speed control means 27 shown in FIG. 1 implements idle speed control in accordance with both a signal which varies directly in proportion to the idle speed error signal e and a signal related to the integral of the signal e. This is accomplished in the following manner. The terminal 26 is connected as an input to an amplifier and combined table look up ROM1 29 which provides an input signal to a limiter circuit 30 that provides an output signal at a terminal 31. The combined input versus output transfer characteristics of the components 29 and 30 is shown in graph b of FIG. 2 wherein for small positive values of the signal e a linear gain relationship PRPGP (proportional gain positive) is provided, whereas for larger values of the signal e a maximum limit of PRPLP (proportional limit positive) is provided. Similar relationships exist for negative values of the signal e. The end result is that at the terminal 31 a signal is provided which is proportional to the difference between actual sensed engine speed RPM and the calculated desired engine idle speed DIDLE.

The terminal 26 at which the signal e is provided is also coupled as an input to a controllable gate 32 which when closed passes this signal as an input to an integrator 33 that provides an output integral signal at a terminal 34. The terminal 34 is provided as an input to a controllable gate 35 which when closed passes this signal as an input to a second amplifier and table look up ROM2 36 which provides an input to a limiter stage 37 that provides an output signal at a terminal 38. When the gates 32 and 35 are closed, the end result is that the integrator 33 will integrate the signal e at the terminal 26 and provide an integrated signal at the terminal 34 as an effective input to the components 36 and 37. Typical transfer characteristics for the components 36 and 37 are illustrated in graph c of FIG. 2 and are similar to the transfer characteristics shown in graph B of FIG. 2 for the components 29 and 30. The end result is that at the terminal 38 a signal related to the integral of the difference between actual engine speed and calculated desired engine idle speed is provided.

It should be noted that the transfer characteristics illustrated in FIGS. b and c are readily implemented by either analog or digital circuits and do not form an essential part ot the present invention. Thus the signals at terminals 31 and 38 could be either analog or digital, and this is the reason for the using the analog-digital terminology, "amplifier ROM".

The proportional signal at the terminal 31 and the integral signal at the terminal 38 are both provided as positive inputs to a summing terminal 39 which provides, in response thereto, an idle speed control signal at an output terminal 40 which is provided as an input to an electrically controllable gate 41 which, when closed, provides a series connection between the terminal 40 and an output terminal 42 which corresponds to a control input terminal for the air bypass valve 28. Thus, when the gate 41 is closed, the amount of air provided by the bypass valve 28 will be determined by the idle speed control signal at the terminal 40.

Each of the controllable gates 32, 35, and 40 has a control terminal designated by prime notation, and each of these control terminals is directly connected to an enable terminal 43 of the idle speed control means 27. When a positive signal is present at the terminal 43, all the gates 32,35 and 41 are closed and the idle speed control means 27 implements engine idle speed control in accordance with the difference between actual engine speed and desired engine idle speed, as well as in accordance with the integral of this difference. It is significant to note that when the engine idle speed apparatus 27 is not enabled (disabled), a low signal is present at the terminal 43 which results in the opening of the gates 32,35 and 41. This prevents the terminal 42 from receiving the engine idle control signal at the terminal 40 and causes the air bypass valve to implement a minimum addition of air to the air fuel mixture. This also causes the integrator 33 to maintain, at its output terminal 34, the magnitude of the integral signal provided at this terminal when the integrator 33 was last enabled. This is because the gates 32 and 35 prevent the integrator 33 from receiving any additional input signals, and prevent the output of the integrator from decaying because of any current drain provided by the components 36 and 37. This is significant since a major aspect of the engine control system 10 is that the integrator 33 of the idle speed control apparatus 27 will maintain its previous magnitude whenever the idle speed control apparatus 27 is disabled. This means that during a subsequent enablement of the idle speed control apparatus 27, there will be no time delay required for the integrator 33 to achieve a desired output at the terminal 34. This feature enables the idle speed control apparatus 27 to more properly respond to engine transients while still providing an integral signal as part of the idle speed control signal provided at the terminal 40, and this will therefore assist the present idle speed control apparatus 27 in preventing overshoot in controlling idle speed.

The manner in which the idle speed control apparatus 27 is enabled and disabled will now be discussed. The error signal e at the terminal 26 is connected to the negative input terminal of a digital comparator 50 which receives at its positive input terminal a reference voltage $V_1$ and provides at an output terminal 51 a digital signal which is a positive (high) logic signal when the signal e is less than the reference voltage $V_1$ and a zero (low) logic signal at other times. The terminal 51 is provided as an input to an AND gate 52 whose output is directly connected to the enablement terminal 43 of the idle speed control apparatus 27. The terminal 23 at which the desired idle speed signal DIDLE is provided is connected to the positive input of a digital comparator 53 which has its negative input directly connected to the terminal 18 at which the actual engine speed signal RPM is provided. The output of the digital comparator 53 is provided at a terminal 54 that is connected to the clock input terminal C of a flip-flop circuit 55. A data terminal D of the flip-flop circuit 55 is connected to a fixed positive voltage B+, and a reset terminal R of the flip-flop is directly connected to the terminal 51. An output terminal Q of the flip-flop provides an output at a terminal 56 which is directly connected as an input to the AND gate 52. The signal at the terminal 56 is designated IDLF signifying idle flag since this signal is representative of both when the error signal e at the terminal 26 is less than an error level corresponding to the signal $V_1$ and when then the actual engine speed signal RPM has fallen below the calculated desired idle speed DIDLE at the terminal 23.

Essentially, until the error signal e falls below the reference level $V_1$, the flip-flop 55 remains reset such that a 0 logic level is provided at the terminal 56. When the signal e is below the reference level $V_1$, then it is possible to set the flip-flop output high. When actual engine speed then first falls below the calculated desired idle speed, the flip-flop 55 will be clocked by a rising signal transition at terminal C and provide a high signal at the terminal 56 representative of a clocked idle speed enablement flag. This high signal will be maintained until the signal e exceeds the level $V_1$ causing the flip-flop to be reset. The high idle flag signal at terminal 56 will provide for enabling the idle speed control apparatus 27 in the event of a closed throttle position, since throttle position is a third input to the AND gate 52 shown in FIG. 1.

In FIG. 1, a throttle position sensor 60 is illustrated in block form as providing an analog throttle position signal THR at a terminal 61. The terminal 61 is connected to the positive input of a digital comparator 62 which has its negative input terminal connected to a reference voltage $V_2$. The digital comparator 62 provides an output at a terminal 63 which is coupled through an inverter 64 as an input to the AND gate 52. Essentially, for a closed throttle (foot off the accelerator pedal) the magnitude of the throttle position signal THR will be less than the reference voltage $V_2$. This will result in 0 logic magnitude at the terminal 63 and therefore result in a positive (high) logic input to the AND gate 52 being provided by the inverter 64. The end result is that in the event of a high idle flag signal at the terminal 56 and a closed throttle position, the AND gate 52 will provide a high output at the terminal 43 resulting in enabling the idle speed control apparatus 27. Disabling of the idle speed apparatus 27 occurs in response to either a non-closed throttle position or the magnitude of the signal e being outside the predetermined range defined by the voltage $V_1$.

An additional significant aspect of the engine control system 10 relates to developing an engine torque polarity signal TQPOL representative of the difference between actual engine fuel consumption and engine fuel consumption which occurs during engine idle speed. Preferably the magnitude of the engine fuel consumption at engine idle speed is not a preset fixed magnitude, but is continuously recalculated each time the engine 11 is operated at engine idle speed. This is accomplished in the following manner.

The engine control system 10 includes an engine manifold air pressure sensor 70 which provides an analog signal MAP, at a terminal 71, which is representative of the sensed engine manifold pressure. The terminal 71 is connected as a positive input to a summing terminal 72. The engine speed signal RPM at the terminal 18 is connected as an input to a MAP adjustment table look up 73 which, in response thereto, provides an output signal at a terminal 74 which is connected as a negative input to the summing terminal 72. The difference output of the summing terminal 72 is provided at an output terminal 75 at which an adjusted MAP signal ADJMAP is provided. The input versus output transfer characteristic of the MAP adjustment table 73 is illustrated in graph d of FIG. 2 and is shown to have a somewhat parabolic shape. The function of the table 73 is essentially to compensate the pressure signal MAP at the terminal 71 for expected variations in no load engine pressure which occur as a function of engine speed, wherein the effects of load have been essentially ignored. Thus the signal at the terminal 75 is representative of a manifold air pressure signal which has been effectively normalized as a function of engine speed.

It has been determined that since no load manifold air pressure appears to vary as a function of engine speed as a parabola, effectively subtracting a parabolic speed compensating signal, such as the signal provided at terminal 74, can provide an engine speed normalized pressure signal at the terminal 75. The transfer characteristic relationship implemented by the table 73 is determined by the type of engine utilized. The end result is that a manifold pressure signal is provided at the terminal 75 which is representative of speed compensated actual sensed engine manifold pressure.

It should be noted that the actual sensed engine manifold pressure is directly related to engine fuel consumption since it forms a reliable measure of the air-fuel mixture consumed by the engine 11. In connection with this, it should be noted that the terminal 71 at which the signal MAP is provided is also provided as a direct input to a fuel control apparatus 80 which provides, as its output, a desired amount fuel to the engine 11. The fuel control apparatus 80 effectively provides fuel to the engine 11 in accordance with the magnitude of the MAP signal at the terminal 71 multiplied by any deceleration factor corresponding to the magnitude of a signal received at an additional input terminal 81 of the fuel control apparatus. Implementing fuel control in this manner is within the skill of those in the art since it amounts merely to providing fuel to the engine in accordance with the magnitude of the analog signal at the terminal 71 multiplied by some additional correction factor represented by the signal at the terminal 81 which is contemplated as having a magnitude ranging from 0 to 1.

As stated previously, a major aspect of the engine control system 10 concerns developing an engine torque polarity signal TQPOL which is related to the difference between actual engine fuel consumption and the engine fuel consumption which exists during no load engine idle speed conditions. If less fuel is being consumed at any time than the fuel which is required during engine idle speed, then clearly the momentum of the engine dominates and there is negative torque polarity indicating that the engine momentum is driving the engine rather than having to supply fuel to the engine to have the engine overcome its own inertia. When a condition of negative torque polarity has been detected, typically it is desirable to reduce the fuel to the engine so as to conserve fuel and to increase the amount of air being supplied to the engine to insure complete combustion of fuel supplied to the engine. Both of these functions will result in the enleanment of the air-fuel mixture to the engine during conditions of negative torque polarity, and this saves fuel and insures more complete combustion of the fuel supplied to the engine thus reducing engine exhaust polution. Thus a key aspect of the engine control system 10 resides in accurately providing a torque polarity signal which can be utilized to develop the proper fuel mixture enleanment functions which are desired. This is accomplished in the following manner.

The speed adjusted pressure signal ADJMAP at the terminal 75 is connected as an input to a controllable gate 82 which when closed provides for directly connecting the terminal 75 to an output terminal 83 which is connected as an input to an integrator circuit 84. The integrator 84 provides an average idle speed pressure signal PIDLE at an output terminal 85 which is connected as a positive input to a summing terminal 86. The actual speed adjusted pressure signal at the terminal 75 is connected as a negative input to the summing terminal 86 which provides at a terminal 87 a difference signal TQPOL representative of engine torque polarity.

Essentially, the gate 82, when closed, allows the integrator 84 to average the speed adjusted pressure signal at the terminal 75 and provides this average signal to the output terminal 85. Since the signal at the terminal 85 is representative of the pressure at idle speed, the gate 82 should be closed only during idle speed conditions. This is accomplished in the following manner.

The error signal e at the terminal 26 which is representative of the difference between actual engine speed and the desired calculated engine idle speed is coupled as an input to a terminal 88 which is provided as the negative input to a digital comparator 89 and the positive input to a digital comparator 90. The positive input of the comparator 89 is connected to a high reference level $V_3$, and the negative input of the comparator 90 is connected to a low reference level $V_4$. The outputs of the comparators 89 amd 90 are provided as inputs to an AND gate 91 which provides, in response thereto, an output signal directly connected to a control terminal 82' of the controllable gate 82. This configuration results in closing the gate 82 when the engine speed error signal e is within the voltage level $V_3$ and $V_4$ which are contemplated as forming a guard band about 0 magnitude for the error signal e. Thus when actual engine speed is approximately the desired calculated engine idle speed, the AND gate 91 will close the gate 82 resulting in the integrator 84 providing at the terminal 85 a manifold pressure signal PIDLE representative of idle speed manifold pressure. When the gate 82 is opened because the engine is no longer in an idle condition, the output of the integrator at the terminal 85 is maintained constant such that the summing terminal 86, which has a high input impedance, will still provide at the terminal 87 a signal related to the difference between actual manifold pressure and the manifold pressure which exists at engine idle speed. In this manner an engine torque polarity signal TQPOL at the terminal 87 is provided.

It should be noted that the pressure adjustment table look up 73 has been added to the control system 10 to merely provide a more accurate indication of torque polarity at the terminal 87, but that even if the table look up 73 were replaced by a direct connection between the terminals 18 and 74, the signal at the terminal 87 will still be substantially representative of the actual torque polarity of the engine 11. It should be noted that the disclosed configuration for providing the torque polarity signal at the terminal 87 provides for continuously monitoring and averaging the amount of engine fuel consumption, as measured by engine manifold pressure, at engine idle conditions and comparing this to the actual manifold pressure which exists at other times. When actual manifold pressure is less than the idle speed manifold pressure, this indicates a negative torque polarity condition indicative of engine momentum driving the engine rather than the utilization of fuel to overcome the engine inertia. In this situation it is typically desirable to reduce engine fuel and increase the amount of air in the engine air-fuel mixture. This is accomplished in the following manner.

The terminal 87 at which the torque polarity signal TQPOL is provided is connected as an input to a controllable gate 95 which when closed provides a direct connection between the terminal 87 and a first deceleration loop up table 96 and a second deceleration look up table 97, each of which providing output signals at terminals 98 and 99, respectively. A control terminal 95' of the gate 95 receives its input from a connection to the terminal 43 through an inverter 100. The connection of the components 95 through 100 results in having the gate 95 block any implementation of fuel control or air bypass control in accordance with the torque polarity signal TQPOL when the idle speed control apparatus 27 is enabled. This is because during enablement of idle speed control the gate 95 is open and provides a zero input to the look up tables 96 and 97. However, at other times the gate 95 will be closed resulting in the torque polarity signal TQPOL being provided as an input to the look up tables 96 and 97. Transfer characteristics for these tables are illustrated in graphs e and f in FIG. 2 wherein for positive values of the signal TQPOL above some minimum threshold, the signal at the terminal 98 will implement, but by virtue of a direct connection of this terminal to the terminal 42, providing of additional air to the air-fuel mixture via the air bypass apparatus 28 in accordance with the magnitude of the signal TQPOL.

It should be remembered that negative torque polarity is indicated by the signal TQPOL exceeding 0 magnitude. Thus for negative torque polarity at other than idle speeds, this is indicative of a deceleration condition which will result in additional air being provided to the air fuel mixture of the engine 11. Similarly, for a magnitude of the torque polarity signal TQPOL above some minimum positive threshold, the amount of fuel provided by the fuel control 80 will be reduced due to the direct connection of the terminal 99 to the terminal 81. This results in a fuel reduction multiplication factor caused by engine deceleration indicated by a positive magnitude of the signal TQPOL. It should be noted that the transfer characteristics illustrated in graphs e and f of FIG. 2 are characteristic of a particular engine and would have to be recalculated for different engines, but that in general the increase of air to the engine fuel mixture and the decrease of fuel to the engine fuel mixture is desired for sufficiently large magnitudes of negative torque polarity which are indicated by a substantial positive magnitude of the signal TQPOL.

The operation of the engine control system 10 will now be explained in conjunction with the signal waveforms illustrated in FIG. 3 wherein the vertical axis of each of these waveforms is representative of magnitude and the horizontal axis is representative of time with the time axes being illustrated on an identical scale for all of the waveforms in FIG. 3.

Figure 3:
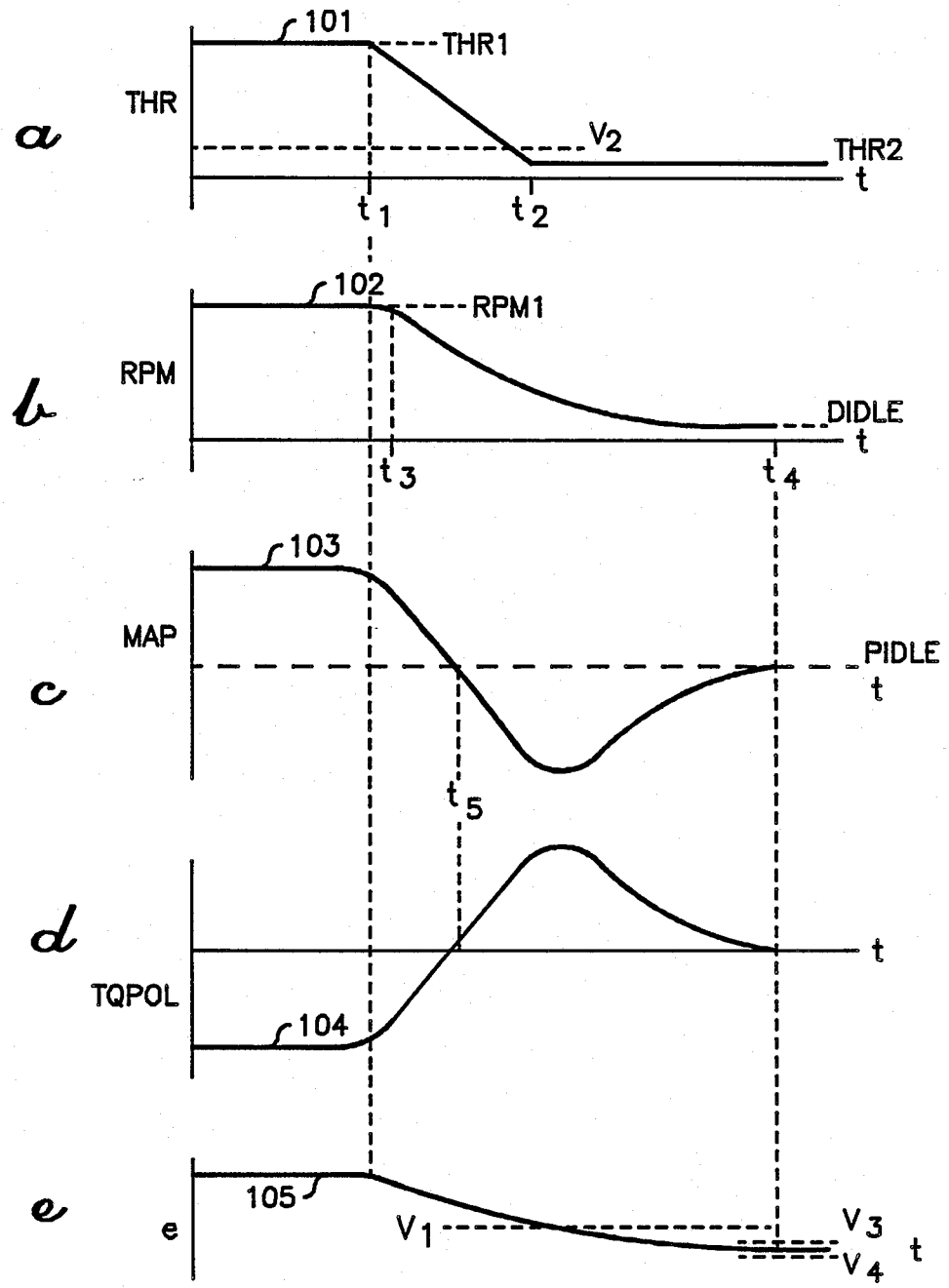
FIGS. 3*a* through 3*e* are a series of graphs illustrating waveforms for various signals provided by the control system shown in FIG. 1.

In graph a in FIG. 3, a signal 101 representative of the throttle position signal THR is illustrated. Prior to a time $t_1$ the throttle position is at a first level THR1. At the time $t_1$, the accelerator pedal is fully released resulting in a decrease in throttle position until at a time $t_2$ a final closed throttle position indicated by the level THR2 is arrived at. It should be noted that this level THR2 is less than the reference level $V_2$ which means that the digital comparator 62 will now produce a low logic level at the terminal 63 whereas previously a high logic level had been produced. The effect of this is to permit the AND gate 52 to enable the idle speed control means 27 after the time $t_2$ if other conditions have been met.

Graph b in FIG. 3 illustrates a signal 102 representative of the signal RPM indicative of engine speed. Prior to the time $t_1$, engine speed is at a level RPM1. At the time $t_3$, slightly after the time $t_1$, engine speed will start to decrease until substantially at a subsequent time $t_4$ engine speed will be approximately equal to the desired engine idle speed DIDLE, at which time the idle speed control apparatus 27 will be enabled and maintain engine speed at this level by virtue of the operation of the air bypass apparatus 28.

Graph c in FIG. 3 illustrates a signal 103 representative of the manifold air pressure signal MAP at the terminal 71. Prior to the time $t_1$, a first level of manifold pressure is maintained, and subsequently this level will decrease to a minimum level of MAP and then subsequently increase such that at approximately the time $t_4$ the idle speed pressure level PIDLE will be obtained. It should be noted that at a time $t_5$ after $t_1$ the manifold pressure signal 103 will decrease below the idle speed pressure reference level PIDLE.

Graph d in FIG. 3 illustrates a signal 104 representative of the engine torque polarity signal TQPOL. Prior to the time $t_1$, this signal is negative indicating that a higher manifold pressure exists than at no load idle speed condition and this is indicative of the engine utilizing fuel to overcome its own inertia. At the time $t_1$, the torque polarity signal 104 starts to increase and will change polarity at the time $t_5$ and maintain a positive polarity until approximately the time $t_4$. Between the times $t_5$ and $t_4$, the signal 104 is positive which is indicative of negative torque polarity meaning that the engine momentum, rather than engine fuel, is causing engine operation.

Graph e in FIG. 3 illustrates a signal 105 representative of the engine speed error signal e at the terminal 26. Prior to the time $t_1$, a substantial positive difference exists between engine speed and calculated engine idle speed. At the time $t_1$, the signal e starts to decrease, and will eventually decrease below the reference level $V_1$ corresponding to the reference voltage applied to the digital comparator 50. Subsequently, the magnitude of the signal e will oscillate around 0 magnitude and be within the guard band represented by the levels $V_3$ and $V_4$. At this time, the gate 82 will be opened such that the integrator 84 will sample the manifold pressure and in response thereto provide an updated average idle speed manifold pressure signal PIDLE at the terminal 85.

Preferably the present invention will be implemented by microprocessor control of an engine. However, this will substantially correspond to the operation of the engine control system 10 shown in FIG. 1. Flowcharts are illustrated in FIG. 4 which describe the preferred microprocessor implementation of the present invention and also correlate to the operation of the hardware embodiment shown in FIG. 1. The flowcharts in FIG. 4 will now be discussed in detail.

A main flowchart program 200 (FIG. 4*b*) is effectively executed periodically. This flowchart is entered at an initial point 201 and is designated the main fuel control program. From 201 control passes to a process block 202 which calculates fuel as a function of manifold air pressure. This is implemented by the fuel control apparatus 80 in FIG. 1. Then control passes to a process block 203 which implements the multiplication of the calculated fuel by any deceleration factors. This represents in effectively multiplying the fuel which was calculated as a function of manifold pressure by any deceleration factors provided at the terminals 98 and 99 in FIG. 1. Control then passes to an implement fuel control process block which represents the actual supplying of fuel to the engine by the fuel control apparatus 80. This is readily implemented by having the degree of opening of a fuel valve controlled by the magnitude of a calculated analog or digital signal. Control then passes to a return step 205 indicative of the multiple periodic execution of the flowchart 200.

Figure 4A:
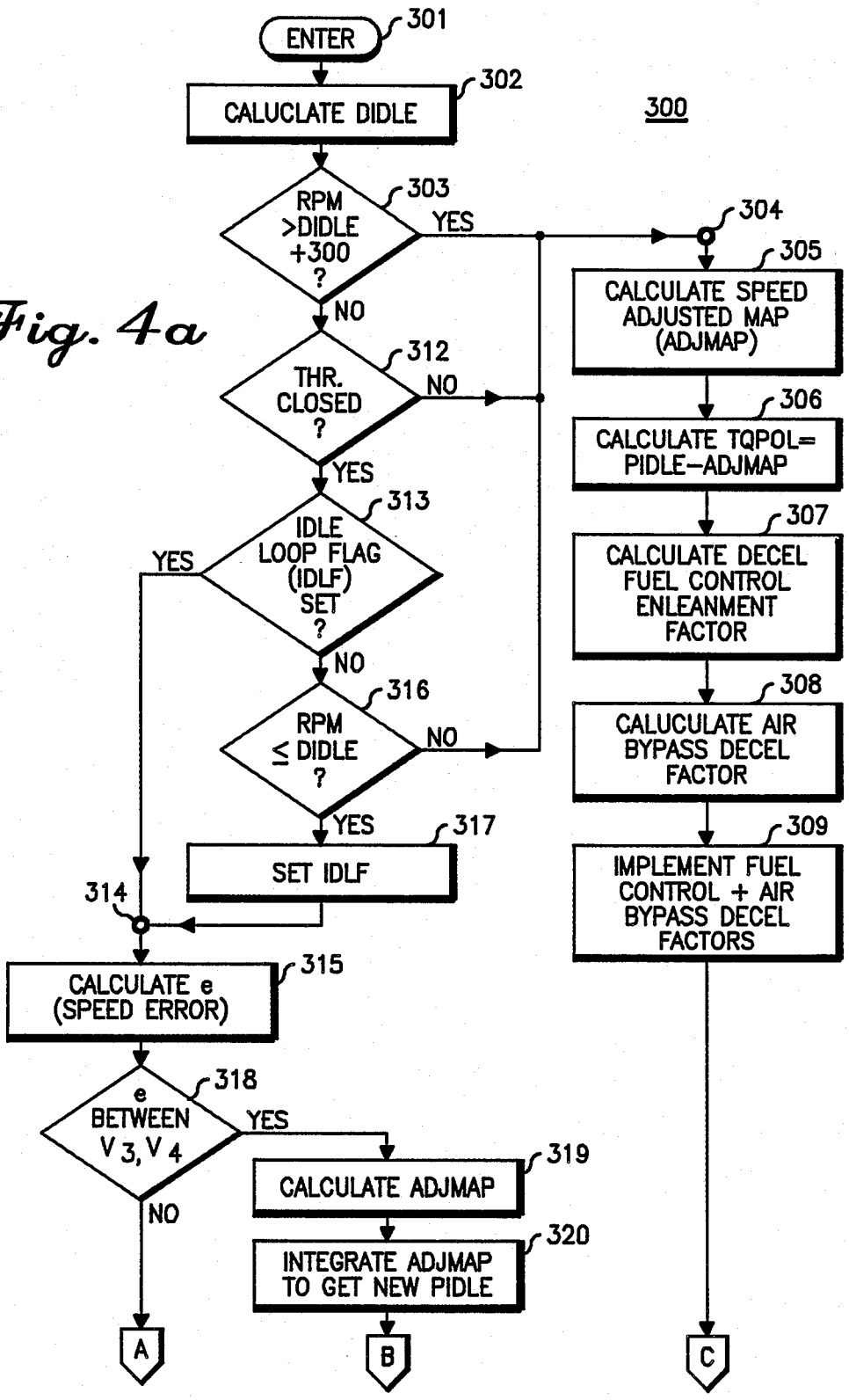
FIGS. 4*a* and 4*b* together illustrate flowcharts showing the operation of the components shown in FIG. 1 and the operation of a preferred microprocessor embodiment of the present invention.
Figure 4B:
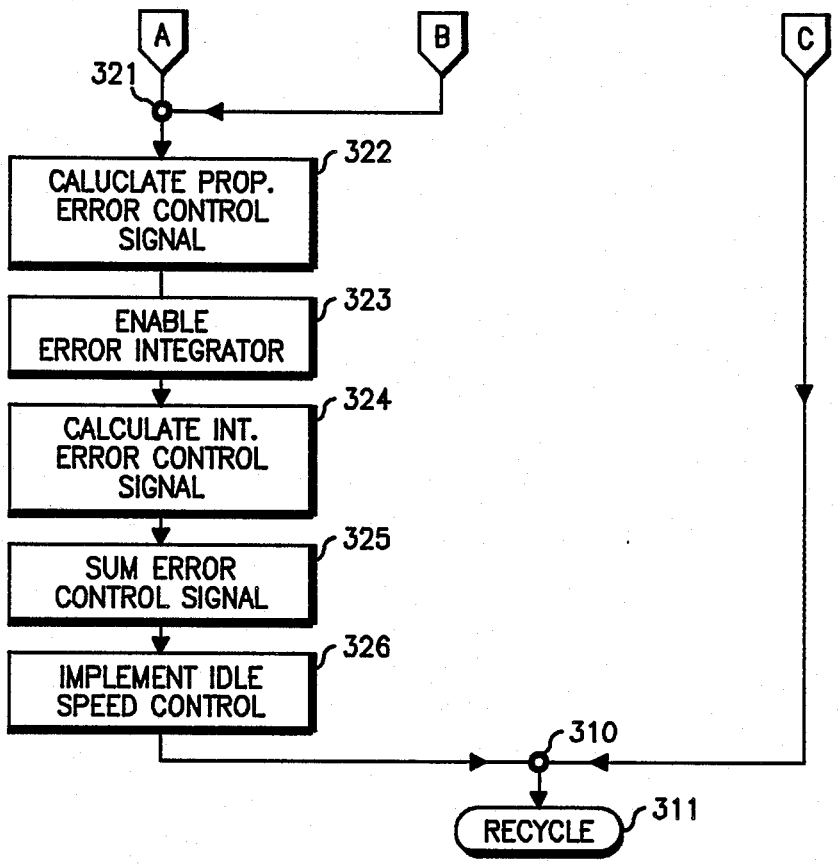
Figure 4B:
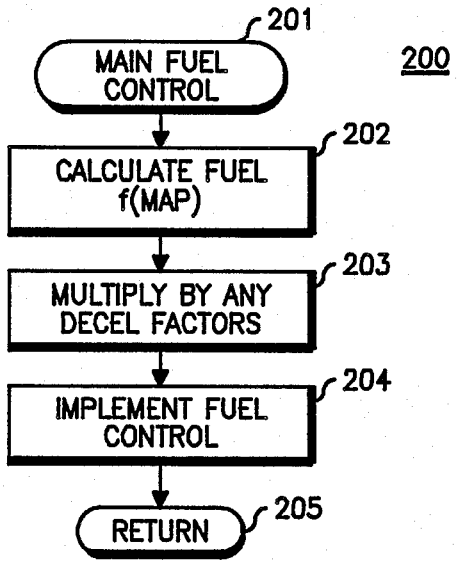

During the periodic execution of the flowchart 200, a flowchart 300 in FIG. 4*a* may also be periodically executed or enterred as part of an interrupt subroutine. This flowchart is entered at an initial point 301 and then the desired idle speed is calculated by a process block 302. Control then passes to a decision block 303 which decides if actual sensed engine speed is above the calculated desired engine idle speed plus 300 RPM. The 300 RPM represents a reference level corresponding to the voltage $V_1$. If this is the case, then idle speed control will not be implemented and control passes to a summing terminal 304. From this terminal control then passes to a process block 305 wherein the speed adjustment factor provided by the look up table 73 is calculated. Control then continues to a process block 306 where the signal TQPOL is calculated by comparing the idle speed pressure signal at the terminal 85 with the speed adjusted pressure signal at the terminal 75. Control then passes to process blocks 307 and 308 wherein the deceleration factors provided by the look up tables 97 and 96 are calculated. Control then passes to a process block 309 which implements these deceleration factors by virtue of the fuel control apparatus 80 and the air bypass apparatus 28. Then control passes to a final summing terminal 310 and from there execution of the flowchart 300 may be periodically repeated as indicated by a recycle step 311.

If the decision block 303 determines that engine speed is below the calculated idle speed plus 300 RPM, then control passes to a decision block 312 which determines if throttle position is closed, and if not control will pass to the terminal 304. lt the throttle position is closed, control passes to a decision block 313 which determines if the idle closed loop flag (IDLF) has been set. This corresponds to determining whether a positive or 0 logic state is present at the terminal 56. If the idle loop flag has been set, control passes to a terminal 314 and then on to a process block 315 which effectively calculates the error signal e as the difference between actual engine speed and the desired calculated idle speed. If the idle loop flag has not been set as determined by the decision block 313, control passes to a decision block 316 which determines if engine speed is equal to or less than the desired idle speed. If not, control returns to the terminal 304. If engine speed is less than the desired idle speed, then the idle speed loop flag is set by a process block 317 and control passes to the terminal 314 for calculation of the signal e. The blocks 316 and 317 represent the setting of the flip-flop 55 and then the resultant enabling of idle speed control by the AND gate 52.

From the process block 315, control passes to a decision block 318 which determines if the error signal e is between the guard band $V_3$ and $V_4$. If it is, then the speed adjustment for manifold pressure is calculated by a process block 319, and the adjusted MAP signal ADJ-MAP is integrated (by the integrator 84) to get a new average idle speed manifold pressure by a process block 320. Control then passes to a summing terminal 321. If the signal e is not between the guard band $V_3$ and $V_4$, control passes from the decision block 18 directly to the terminal 321. From the terminal 321, control passes to a series of process blocks 322, 323, 324, 325 and 326, and then to the summing terminal 310. The process blocks 322 through 326 essentially calculate the proportional error control signal at the terminal 31, enable the error signal integrator 33 by closing the gates 32 and 35, calculate the integral error control signal at the terminal 38, sum the proportional and integral signals to provide the composite idle speed control signal at the terminal 40, and implement idle speed control by providing a control signal through the gate 41 to the air bypass apparatus 28.

While specific embodiments of the present invention have been shown and described, further modifications and improvements will occur to those skilled in the art. All such modifications which retain the basic underlying principles disclosed and claimed herein are within the scope of this invention.

I claim:

1. An engine control system including engine idle speed control apparatus, comprising:

means for providing an error signal related to the difference between actual sensed engine speed and a desired engine idle speed;

means coupled to said error signal providing means for implementing, when enabled, a closed loop engine idle speed control in accordance with a control signal related to at least the magnitude of said error signal; and means coupled to said engine idle speed control means for selectively enabling said closed loop idle speed control means in response to at least the magnitude of said actual speed being substantially equal to said desired engine idle speed, and disabling and closed loop control means whenever said actual speed is above a predetermined speed which is greater than said desired speed, wherein said closed loop idle speed control means includes means for positioning air-fuel mixture control apparatus in accordance with said control signal, and means for storing, until said closed loop idle speed control means is enabled, the magnitude of a signal related to the position of said control apparatus at a magnitude related to the magnitude which existed when said closed loop idle speed control means was last enabled, and utilizing said stored magnitude to implement initial closed loop control of said air-fuel mixture control apparatus by initially determining said control signal when said idle speed control means is enabled.

2. An engine control system according to claim 1 wherein said closed loop idle speed control means also comprises means for developing a signal varying substantially in direct proportion to said error signal, said control signal being a function of both said direct proportion signal and the integral of said error signal.

3. An engine control system according to claim 1 wherein said control means includes an integrator means for developing an output signal representative of the integral of said error signal, wherein said control signal is determined in accordance with at least the magnitude of said output integral signal, and wherein said storing means includes means for holding, when said control means is disabled, the magnitude of said output integral signal constant at a magnitude related to the magnitude which existed when the closed loop control means was last enabled.

4. An engine control system according to claim 1 wherein said enabling means includes means for enabling said closed loop engine idle speed control means in response to a throttle positioin sensor signal having a magnitude indicative of a closed throttle position, in addition to said actual speed being substantially equal to said desired idle speed.

5. An engine control system according to claim 4 wherein said enabling means includes means for disabling said closed loop engine speed control means in response to any one of said error signal being outside of a predetermined range about zero magnitude and said throttle position signal indicating other than a closed throttle position.

6. An engine control system according to claim 1 wherein said enabling and disabling means includes a flip-flop means providing an output signal controlling the enabling and disabling of said closed loop control means.

7. An engine control system according to claim 6 wherein said flip-flop means includes a reset terminal coupled to an output of a comparator which receives, as one input, said error signal and which receives, as another input, a reference potential.

8. An engine control system according to claim 7 wherein said flip-flop means has a clock terminal coupled to an output terminal of a comparator which receives, as its inputs, a signal related to said actual engine speed and a signal related to said desired engine speed, and wherein said comparator provides a digital output signal to said flip-flop clock terminal.

9. An engine control system including engine idle speed control apparatus, comprising:

means for providing an error signal related to the difference between actual sensed engine speed and a desired engine idle speed;

means coupled to said error signal providing means for implementing, when enabled, a closed loop engine idle speed control in accordance with a control signal related to at least the magnitude of said error signal;

means coupled to said idle speed control means for selectively enabling said closed loop idle speed control means in response to at least the magnitude of said error signal being within a predetermined range about zero magnitude;

sensor means for developing a signal related to the amount of fuel consumption of said engine;

means coupled to said sensor means and said error signal providing means for (1) developing a signal related to the amount of engine fuel consumption during an engine idle condition by effectively sampling the sensed fuel consumption signal whenever the engine speed error signal is within a predetermined range about zero magnitude and, (2) storing said signal related to the engine fuel consumption during engine idle when the engine speed error signal exceeds said predetermined range; and means coupled to said idle speed fuel consumption signal providing means for utilizing said stored sensed idle speed fuel consumption signal for engine control at times other than when said idle speed control means is enabled.

10. An engine control system according to claim 9 wherein said fuel consumption signal corresponds to a signal related to the amount of air utilized in the engine fuel mixture.

11. An engine control system according to claim 10 wherein said closed loop engine idle speed control means includes means for selectively receiving said idle speed control signal related to the magnitude of said error signal when said idle speed control means is enabled and providing in response thereto at least a controlled amount of air, related to the magnitude of said control signal, to the engine fuel mixture to implement engine idle speed control.

12. An engine control system according to claim 10 wherein said utilizing means includes means for providing an engine torque polarity signal related to the difference between sensed engine manifold air pressure and a predetermined level of air pressure related to idle speed air pressure, and means for selectively, in response to engine operating conditions, causing said controlled air means to provide air to the engine fuel mixture in accordance with the magnitude of said torque polarity signal rather than said idle speed control signal.

* * * * *

UNITED STATES PATENT AND TRADEMARK OFFICE

CERTIFICATE OF CORRECTION

PATENT NO. : 4,597,047

DATED : June 24, 1986

INVENTOR(S) : Robert W. Deutsch

It is certified that error appears in the above-identified patent and that said Letters Patent is hereby corrected as shown below:

Claim 1, Column 12, line 65, please delete "and" and insert --said--.

Claim 4, Column 13, line 33, please delete "positioin" and insert --position--.

Signed and Sealed this

Twenty-eighth Day of October, 1986

[SEAL]

*Attest:*

DONALD J. QUIGG

*Attesting Officer* *Commissioner of Patents and Trademarks*